US012085295B2

(12) United States Patent
Schuster et al.

(10) Patent No.: US 12,085,295 B2
(45) Date of Patent: Sep. 10, 2024

(54) HEAT PUMP FAULT DETECTION SYSTEM

(71) Applicant: Trane International Inc., Davidson, NC (US)

(72) Inventors: Don A. Schuster, Lindale, TX (US); Prabakaran Chezhian, Tamil Nadu (IN); Logenthiran Vazhmuni, Tamil Nadu (IN)

(73) Assignee: Trane International Inc., Davidson, NC (US)

( * ) Notice: Subject to any disclaimer, the term of this patent is extended or adjusted under 35 U.S.C. 154(b) by 261 days.

(21) Appl. No.: 17/705,849

(22) Filed: Mar. 28, 2022

(65) Prior Publication Data

US 2023/0304686 A1 Sep. 28, 2023

(51) Int. Cl.

| | |
|---|---|
| ***F24F 11/32*** | (2018.01) |
| ***F24F 11/84*** | (2018.01) |
| ***F24F 11/86*** | (2018.01) |

(52) U.S. Cl.

CPC ..... *F24F 11/32* (2018.01); *F24F 11/84* (2018.01); *F24F 11/86* (2018.01); *F24F 2203/02* (2013.01)

(58) Field of Classification Search

CPC .. F24F 11/32; F24F 11/84; F24F 11/86; F24F 2203/02; F24F 2140/12; F24F 2140/20;

(Continued)

(56) References Cited

U.S. PATENT DOCUMENTS 4,211,089 A 7/1980 Mueller et al.
4,301,660 A 11/1981 Mueller et al.

(Continued)

FOREIGN PATENT DOCUMENTS

CN 107477926 A * 12/2017
EP 0 033 781 A3 8/1981

(Continued)

OTHER PUBLICATIONS

"Bryan Orr, How a Heat Pump Reversing Valve Works, Feb. 12, 2021, https://hvacrschool.com/how-heat-pump-reversing-valve-works/ " (Year: 2021).*

*Primary Examiner* — Santosh R Poudel
(74) *Attorney, Agent, or Firm* — Womble Bond Dickinson (US) LLP

(57) ABSTRACT

Example embodiments of the present disclosure relate to a heat pump including a system or method for detecting a fault in the heat pump. Some embodiments include a method for detecting a switch over valve fault where the heat pump includes a refrigerant cycle, a compressor, a first heat exchanger, a second heat exchanger, and a switch over valve, and the method includes operating the HVAC system in one of a heating mode or a cooling mode, monitoring first, second, and third refrigerant parameters associated with the refrigerant circuit using first, second, and third refrigerant sensors, determining first and second refrigerant inputs based on the first, second, and third second refrigerant parameters, and determining a refrigerant circulation mode by comparing the first refrigerant input to the second refrigerant input to provide an indication of whether the refrigerant is circulating in the heating mode or the cooling mode.

24 Claims, 7 Drawing Sheets

(58) Field of Classification Search
CPC ..... F25B 49/005; F25B 2700/1931; F25B 2700/1933; F25B 2700/21151; F25B 2700/21152; F25B 13/00
See application file for complete search history.

(56) References Cited

U.S. PATENT DOCUMENTS

| | | | | |
|---|---|---|---|---|
| 9,285,802 | B2 | 3/2016 | Arensmeier | |
| 9,638,436 | B2 | 5/2017 | Arensmeier et al. | |
| 10,371,395 | B2 | 8/2019 | Rite et al. | |
| 10,675,940 | B2 | 6/2020 | Peng et al. | |
| 10,712,036 | B2 | 7/2020 | Mowris et al. | |
| 10,782,040 | B2 | 9/2020 | Wacker | |
| 11,293,659 | B2 | 4/2022 | Brahme et al. | |
| 2005/0262857 | A1 | 12/2005 | Hrejsa et al. | |
| 2018/0031266 | A1 | 2/2018 | Atchison et al. | |
| 2019/0331374 | A1* | 10/2019 | Xue | F25B 49/022 |
| 2020/0370804 | A1 | 11/2020 | Snider et al. | |
| 2021/0302040 | A1* | 9/2021 | Brahme | F24F 11/38 |
| 2022/0107135 | A1* | 4/2022 | Thobias | F24F 11/52 |
| 2022/0364777 | A1* | 11/2022 | Tada | F25B 41/20 |

FOREIGN PATENT DOCUMENTS

| | | | |
|---|---|---|---|
| EP | 0033781 | A3 | 5/1982 |
| EP | 2705311 | A4 | 10/2014 |
| WO | WO 2012/151037 | A1 | 11/2012 |

* cited by examiner

HEAT PUMP FAULT DETECTION SYSTEM

INCORPORATION BY REFERENCE

The disclosure of U.S. patent application Ser. No. 17/216,310 (now U.S. Pat. No. 11,774,151), entitled Heat Pump Reversing Valve Fault Detection System, filed on Mar. 29, 2021, is hereby incorporated by reference for all purposes as if presented herein in its entirety.

TECHNOLOGICAL FIELD

The present disclosure relates generally to an improved device and method for determining whether a fault is occurring in a heating, ventilating, and air conditioning (HVAC) system, potentially with the switch over valve.

BACKGROUND

Heat pumps are becoming increasing popular HVAC devices because of the efficiencies these devices offer, including, for example, energy savings, packaging size reductions, and other advantages. These HVAC systems require the use of two opposite refrigeration cycles, typically a heating mode cycle and a cooling mode cycle. To utilize the advantages these systems offer, the heating and cooling mode cycles often use some or all of the same components. Given the differences between these two cycles and the number of components involved, errors may occur.

One failure that is particular to these types of HVAC systems occurs when an HVAC system fails to operate in the appropriate refrigeration cycle for a given demand or situation. For example, a heat pump may receive a call to heat a given space, but due to a fault in the system, the refrigerant may flow in a cooling mode cycle. The opposite may also occur. These faults can cause a failure to satisfy a conditioning demand.

There can be several causes for misdirected refrigerant, however, many current HVAC systems struggle to detect these issues. Also troubling is that current HVAC systems typically do not provide any assessment of the underlying cause(s). As a result, service technicians are often required to diagnose faults on site, which may lead to downtime and increased repair and/or operation costs. This is common even when the root cause is relatively minor. Moreover, existing HVAC systems fail to address or implement corrective action after faults have been detected.

BRIEF SUMMARY

The present disclosure addresses these deficiencies and provides a system for detecting a fault in the HVAC system, potentially a heat pump. In some embodiments, the fault detected relates to the switch over valve, and in some embodiments, the system and method take corrective action and/or publishes that the fault has occurred.

The present disclosure thus includes, without limitation, the following example embodiments.

Some example implementations provide a heat pump comprising: a compressor, a metering device, a first heat exchanger, and a second heat exchanger, the second heat exchanger positioned in fluid communication with an indoor environment for selectively conditioning the indoor environment; a refrigerant circuit comprising a refrigerant fluid arranged to circulate between the first heat exchanger and the second heat exchanger; a first refrigerant sensor configured to provide a signal indicative of a first refrigerant parameter, the first refrigerant parameter being associated with refrigerant fluid flowing away from the compressor; a second refrigerant sensor configured to provide a signal indicative of a second refrigerant parameter, the second refrigerant parameter being associated with refrigerant fluid flowing into the compressor; a third refrigerant sensor configured to provide a signal indicative of a third refrigerant parameter, the third refrigerant parameter being associated with refrigerant fluid proximate the second heat exchanger; a switch over valve coupled to the refrigerant circuit configured to adjust a path of the refrigerant fluid between the first heat exchanger and the second heat exchanger in the refrigerant circuit, wherein the switch over valve comprises a heating mode position that directs the refrigerant fluid in a heating mode cycle to heat the indoor environment, and a cooling mode position that directs the refrigerant fluid in a cooling mode cycle to cool the indoor environment; and control circuitry, wherein the control circuitry is configured to: send or receive a call, the call indicative of whether to heat the indoor environment or cool the indoor environment; determine a first refrigerant input based on the signal from the first refrigerant sensor and the signal from the third refrigerant sensor; determine a second refrigerant input based on the signal from the second sensor and the signal from the third refrigerant sensor; determine whether the switch over valve is in the heating mode position or the cooling mode position by comparing the first refrigerant input to the second refrigerant input; and declare a switch over valve fault if the determined switch over valve position is inconsistent with the call.

In some example implementations of the heat pump of any example implementation, or any combination of any preceding example implementation, the first, second, and third refrigerant sensors are temperature sensors, and the first, second, and third refrigerant parameters are temperatures of the refrigerant.

In some example implementations of the heat pump of any example implementation, or any combination of any preceding example implementation, the third refrigerant sensor is located at a position along the refrigerant circuit where the refrigerant is in a gas phase during both the heating mode cycle and the cooling mode cycle.

In some example implementations of the heat pump of any example implementation, or any combination of any preceding example implementation, the control circuitry is further configured to: measure a time period that starts when the call is sent or received; and declare the switch over valve fault if both the determined switch over valve position is inconsistent with the call and the measured time period has exceeded a predetermined time period.

In some example implementations of the heat pump of any example implementation, or any combination of any preceding example implementation, the control circuitry configured to determine the first refrigerant input further includes control circuitry to determine the first refrigerant input by filtering the signals from the first refrigerant sensor and the third refrigerant sensor, and wherein the control circuitry configured to determine the second refrigerant input further includes control circuitry to determine the second refrigerant input by filtering the signals from the second refrigerant sensor and the third refrigerant sensor.

In some example implementations of the heat pump of any example implementation, or any combination of any preceding example implementation, the first refrigerant parameter signal corresponds to a refrigerant discharge value, the third refrigerant parameter signal corresponds to a second heat exchanger value, and the control circuitry configured to determine the first refrigerant input includes control circuitry configured to subtract the second heat exchanger value from the refrigerant discharge value.

In some example implementations of the heat pump of any example implementation, or any combination of any preceding example implementation, the second refrigerant parameter signal corresponds to a refrigerant suction value, the third refrigerant parameter signal corresponds to a refrigerant suction value, and the control circuitry configured to determine the second refrigerant input includes control circuitry configured to subtracting the refrigerant suction value from the second heat exchanger value.

In some example implementations of the heat pump of any example implementation, or any combination of any preceding example implementation, the control circuitry is further configured to: measure a time period that starts when the temperature difference is determined to be greater than the predetermined temperature difference threshold; and declare the switch over valve fault after the measured time period exceeds a predetermined time period.

In some example implementations of the heat pump of any example implementation, or any combination of any preceding example implementation, the determination whether the switch over valve is in the heating mode position or the cooling mode position includes a determination the switch over valve is in the cooling mode position if the first refrigerant input is greater than the second refrigerant input or a determination the switch over valve is in the heating mode position if the second refrigerant input is greater than the first refrigerant input.

In some example implementations of the heat pump of any example implementation, or any combination of any preceding example implementation, the control circuitry is further configured to deactivate the compressor upon a declaration that a switch over valve fault has occurred.

In some example implementations of the heat pump of any example implementation, or any combination of any preceding example implementation, the control circuitry is further configured to activate the compressor after a predetermined reset time period following deactivation of the compressor.

In some example implementations of the heat pump of any example implementation, or any combination of any preceding example implementation, the control circuitry is further configured to: de-energize the switch over valve upon a declaration that a switch over valve fault has occurred; and re-energize the switch over valve after de-energizing the switch over valve.

In some example implementations of the heat pump of any example implementation, or any combination of any preceding example implementation, the control circuitry is further configured to lock down the heat pump after a predetermined number of switch over valve faults have occurred.

Some example implementations provide a method of detecting a switch over valve fault in a heat pump, the method comprising: sending or receiving a call to operate the heat pump in one of a heating mode and a cooling mode; monitoring a first refrigerant parameter associated with a refrigerant circuit of the heat pump using a first refrigerant sensor located proximate a discharge end of a compressor of the heat pump; monitoring a second refrigerant parameter associated with the refrigerant circuit of the heat pump using a second refrigerant sensor located proximate a suction end of the compressor of the heat pump; monitoring a third refrigerant parameter using a third refrigerant sensor located proximate a heat exchanger of the heat pump, the heat exchanger positioned in fluid communication with an indoor environment for selectively conditioning the indoor environment; determining a first refrigerant input based on the first refrigerant parameter and the third refrigerant parameter; determining a second refrigerant input based the second refrigerant parameter and the third refrigerant parameter; determining a refrigerant circulation mode by comparing the first refrigerant input to the second refrigerant input, the comparison providing an indication regarding whether the refrigerant is circulating in the heating mode or the cooling mode; and declaring a switch over valve fault if the determined refrigerant circulation mode is different from the mode sent or received in the call to operate.

In some example implementations of the method of any example implementation, or any combination of any preceding example implementation, the first, second, and third refrigerant sensors are temperature sensors, and the first, second, and third refrigerant parameters are temperatures of the refrigerant.

In some example implementations of the method of any example implementation, or any combination of any preceding example implementation, the third refrigerant sensor is located at a position along the refrigerant circuit where the refrigerant is in a gas phase during both the heating mode and the cooling mode of the heat pump.

In some example implementations of the method of any example implementation, or any combination of any preceding example implementation, measuring a time period that starts when the call to operate the heat pump in the heating mode or the cooling mode is sent or received; and declaring the switch over valve fault if both the determined refrigerant circulation mode is different from the mode sent or received in the call to operate and the measured time period has exceeded a predetermined time period.

In some example implementations of the method of any example implementation, or any combination of any preceding example implementation, determining the first refrigerant input further includes averaging the respective signals from the respective first refrigerant sensor and the third refrigerant sensor over a predetermined time period, and determining the second refrigerant input further includes averaging the respective signals from the respective second refrigerant sensor and the third refrigerant sensor over the predetermined time period.

In some example implementations of the method of any example implementation, or any combination of any preceding example implementation, the first refrigerant parameter signal corresponds to a refrigerant discharge temperature value ($T_D$), the second refrigerant parameter signal corresponds to a refrigerant suction temperature value (Ts), the third refrigerant parameter signal corresponds to a refrigerant heat exchanger temperature value (THE), and the first refrigerant input ($R_1$) is determined using the following equation: $R_1=T_D-T_{HE}$.

In some example implementations of the method of any example implementation, or any combination of any preceding example implementation, the second refrigerant input ($R_2$) is determined using the following equation: $R_2=T_{HE}-T_S$.

In some example implementations of the method of any example implementation, or any combination of any preceding example implementation, determining the refrigerant circulation mode further includes determining the refrigerant circulation mode is in cooling mode if $R_1>R_2$ or determining the refrigerant circulation mode is in heating mode if $R_1<R_2$.

In some example implementations of the method of any example implementation, or any combination of any preceding example implementation, the method further comprises deactivating the compressor upon a determination that a switch over valve fault has occurred.

In some example implementations of the method of any example implementation, or any combination of any preceding example implementation, the method further comprises activating the compressor after a predetermined reset time period following deactivation of the compressor.

In some example implementations of the method of any example implementation, or any combination of any preceding example implementation, the method further comprises de-energizing the switch over valve upon a determination that a switch over valve fault has occurred; and re-energizing the switch over valve after de-energizing the switch over valve.

In some example implementations of the method of any example implementation, or any combination of any preceding example implementation, the method further comprises locking down the heat pump after a predetermined number of switch over valve faults have occurred.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
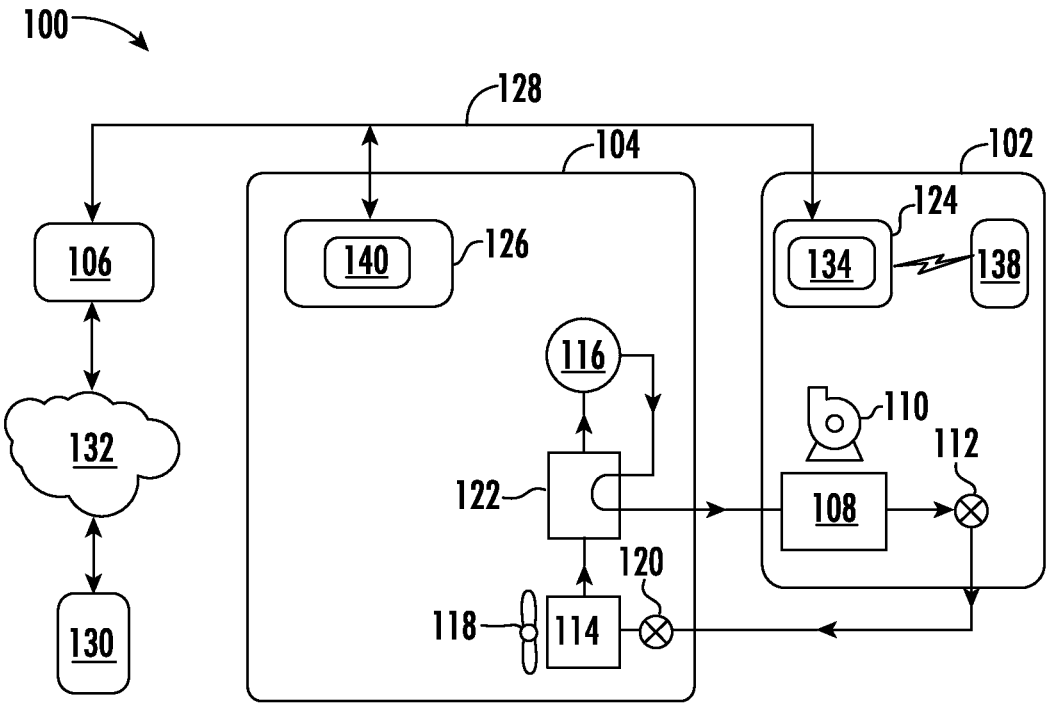
FIG. 1 is a schematic of an HVAC system, according to an example embodiment of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration). It is understood that such terms are not used in any absolute sense.

Example embodiments of the present disclosure relate generally to an improved system and method for detecting a fault in an HVAC system, potentially a heat pump. In some embodiments, the fault detected relates to the switch over valve, and in some embodiments, the system and method take corrective action and/or publish, declare, or otherwise provide an indication that the fault has occurred. Example embodiments will primarily be described in conjunction with a switch over valve used for the refrigerant circuit within a heat pump device (either in split system or package unit configuration), but it should be understood that example embodiments may be utilized in conjunction with a variety of other applications. For example, other HVAC devices and/or fluid flows may utilize the system and method disclosed herein, including water-cooled HVAC systems, rooftop units, etc., as well as other devices generally, including water heaters, kitchen appliances, and the like. Furthermore, it should be understood that unless otherwise specified, the terms "data," "content," "digital content," "information," and similar terms may be at times used interchangeably.

Example embodiments of the present disclosure relate to an HVAC system that includes a refrigerant circuit where a refrigerant fluid is circulated by a compressor. This refrigerant circuit circulates between a heat providing heat exchanger configuration that directs heat into selected portions of the refrigerant circuit, and a heat discharging heat exchanger configuration that directs heat out of selected portions of the refrigerant circuit. In some embodiments, at least one metering device, potentially an expansion valve, is also included to adjust the pressure of the refrigerant fluid within the refrigerant circuit. These embodiments may further include a switch over valve (SOV), which may be referred to as a reversing valve and may vary the flow of the refrigerant fluid within the refrigerant circuit between the heat exchangers and/or other components coupled to the refrigerant circuit.

In one embodiment, the disclosed system and/or method for controlling this HVAC device utilizes temperature inputs for determining whether a fault has occurred in the HVAC system. In some embodiments, the system declares that a fault has occurred in the switch over valve. The fault may be detected by monitoring the temperature associated with the refrigerant fluid at selected points along the refrigerant cycle. The system may identify that a fault has occurred upon a comparison of differences between these temperatures. In some embodiments, the system takes corrective action to address the underlying cause of the fault. Some embodiments also include publishing and/or transmitting an alert or other indicator that a fault has occurred.

In one example embodiment, the HVAC device utilizing the disclosed system and method is a heat pump. Below is an overview of the system and method used to detect a fault in a heat pump system. Further details regarding the heat pump, and the system and method are discussed after this overview.

In some embodiments, the heat pump is in a split-system configuration and includes an outdoor unit and an indoor unit. In some embodiments, the heat pump system is in a packaged unit configuration where the components described below for the indoor unit and outdoor unit are located within a single unit that is typically located outside a building. The outdoor unit may include a compressor and an outdoor heat exchanger, potentially a first heat exchanger. The indoor unit may include a metering device such as an expansion valve and an indoor heat exchanger, potentially a second heat exchanger. Some embodiments may also include a refrigerant circuit that circulates a refrigerant fluid between the first and second heat exchangers. In some embodiments, the refrigerant circuit includes at least two different refrigerant cycles, potentially a heating mode cycle and a cooling mode cycle. Some embodiments may include a switch over valve that directs the refrigerant fluid in the refrigerant circuit in either the heating mode cycle or the cooling mode cycle.

In some embodiments, the heat pump includes the switch over valve coupled to the refrigerant cycle. The switch over valve (sometimes referred to as a reversing valve) serves to direct the refrigerant flow in the refrigerant cycle in the appropriate manner, e.g. the heating mode cycle when the heat pump is operating in a heating mode and the cooling mode cycle when the heat pump is operating in a cooling mode.

In some embodiments, one or more temperature sensors are used to measure various different aspects of the system as well as components and/or fluids associated with the system. In some embodiments, temperature sensors monitor the temperature associated with the refrigerant fluid at various different points within the refrigerant cycle. Some embodiments include one or more temperature sensors monitoring the temperature of refrigerant flowing into a compressor of the heat pump and out of the compressor of the heat pump.

In some embodiments, control circuitry determines whether a switch over valve fault occurred within the HVAC device. In some examples, the fault relates to the switch over valve position and/or manner in which the refrigerant fluid flows through the refrigerant cycle. For example, the switch over valve fault may occur when the switch over valve directs the refrigerant fluid in the heating mode cycle when the HVAC device sends or receives a call to operate in a cooling mode. The switch over valve fault may also occur when the switch over valve directs the refrigerant fluid to flow in the cooling mode cycle when the HVAC device sends or receives a call to operate in a heating mode.

The control circuit determines a fault has occurred in the HVAC device using various methods and inputs. In some embodiments, the control circuitry determines this fault based on various inputs and predetermined threshold values. In some embodiments, the control circuitry sends or receives an indication to operate the HVAC device, potentially a heat pump, in either a heating mode or a cooling mode, potentially via a heating or cooling call. The control circuitry receives an indication of a parameter associated with the refrigeration fluid within the refrigerant cycle. This indication may be provided in a variety of ways as discussed more below. The control circuitry may determine a refrigerant input based on the parameter information it receives, potentially from one or more sensors, and the refrigerant input may be indicative of a property of the refrigerant fluid or a change in the property of the refrigerant fluid. In some embodiments, such inputs may undergo a degree of filtering, in one example, by averaging the information collected over a predetermined time period.

In some embodiments, the control circuitry may also receive an indication of a parameter of refrigerant exiting the compressor of the HVAC device, e.g., a refrigerant discharge value, a parameter of refrigerant entering the compressor of the HVAC device, e.g., a refrigerant suction value, and a parameter of refrigerant proximate an indoor heat exchanger of the HVAC device, e.g., a heat exchanger value. The control circuitry may also include control circuitry configured to subtract the heat exchanger value from the refrigerant discharge value to provide a first refrigerant input, and to subtract the refrigerant suction value from the heat exchanger value to provide a second refrigerant input. The determination of whether a fault has occurred within the HVAC device can include a determination based on whether the first refrigerant input is greater than the second refrigerant input or if the second refrigerant input is greater than the first refrigerant input.

In some embodiments, the fault relates to a switch over valve fault, and in some embodiments, this fault indicates that the switch over valve is circulating the refrigerant fluid in a heating mode cycle when the HVAC device sent or received a call to operate in a cooling mode, e.g., a cooling mode call, or this fault indicates that the switch over valve is circulating refrigerant fluid in the cooling mode cycle when the HVAC device sent or received a call to be operate in a heating mode, e.g., a heating mode call. In some embodiments, the control circuitry includes a timer. This timer may provide an indication of how long the first refrigerant input has been greater than the second refrigerant input or vice-versa. In some embodiments, the control circuitry declares a fault only after an inconsistency between the switch over valve position and the heating mode call has exceeded a set period of time, e.g., the timer expires. In some embodiments, the control circuitry publishes this fault, potentially by publishing an alert or other indicator, indicating a fault has occurred. In some embodiments, the control circuitry includes control circuitry to effect corrective action, which in some embodiments includes de-energizing and re-energizing the switch over valve.

Referring now to FIG. 1, the features and steps will be discussed in more detail. FIG. 1 shows a schematic diagram of a typical HVAC system 100. Most generally, HVAC system 100 comprises a heat pump system that may be selectively operated to implement one or more substantially closed thermodynamic refrigerant cycles to provide a cooling functionality (hereinafter a "cooling mode cycle") and/or a heating functionality (hereinafter a "heating mode cycle"). The embodiment depicted in FIG. 1 is configured in a heating mode cycle. The HVAC system 100, configured as a split system heat pump system, generally comprises an indoor unit 102, an outdoor unit 104, and a system controller 106 that may generally control operation of the indoor unit 102 and/or the outdoor unit 104. In some embodiments, the system controller 106 can have the form of a control device such as a thermostat or hub in electrical communication with various components of the system 100. The heat pump system may also comprise a packaged unit where the components described below for the indoor unit and outdoor unit are located within a single unit.

Indoor unit 102 generally comprises an indoor air handling unit comprising an indoor heat exchanger 108, an indoor fan 110, an indoor metering device 112, and an indoor controller 124. In some embodiments, the indoor unit 102 may also comprise a plurality of sensors for measuring parameters of the refrigerant at the indoor heat exchanger 108, the return air temperature, the supply air temperature, the indoor ambient temperature, etc. The indoor heat exchanger 108 may generally be configured to promote heat exchange between a refrigerant fluid carried within internal tubing of the indoor heat exchanger 108 and an airflow that may contact the indoor heat exchanger 108 but that is segregated from the refrigerant fluid. In some embodiments, including some packaged unit embodiments, the indoor heat exchanger may be referred to as a conditioned air heat exchanger, the indoor fan may be referred to as the conditioned air fan, the indoor metering device may be referred to as the conditioned air metering device, and the indoor system controller may be referred to as the conditioned air system controller. In these embodiments these components are located in the same position in the thermodynamic cycle as described in the embodiments disclosed with respect to the components of the indoor unit.

The indoor metering device 112 may generally comprise an electronically-controlled motor-driven EEV. In some embodiments, however, the indoor metering device 112 may comprise a thermostatic expansion valve, a capillary tube assembly, and/or any other suitable metering device. In some embodiments, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a switch over valve 122, and an outdoor controller 126. In some embodiments, the outdoor unit 104 may also comprise a plurality of sensors for measuring parameters of the refrigerant at the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but is segregated from the refrigerant. In some embodiments, including some packaged unit embodiments, the outdoor heat exchanger may be referred to as an outdoor ambient air heat exchanger, the outdoor fan may be referred to as the outdoor ambient air fan, the outdoor metering device may be referred to as the outdoor ambient air metering device, and the outdoor system controller may be referred to as the outdoor ambient air system controller. In these embodiments these components are located in the same position in the thermodynamic cycle as described in the embodiments disclosed with respect to the components of the outdoor unit.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

Figure 4A:
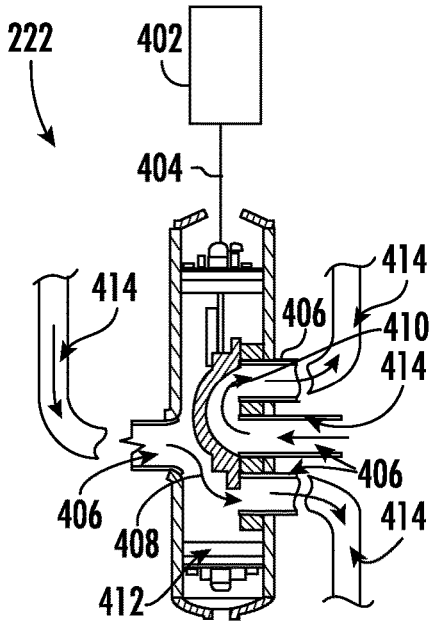
FIG. 4A is a cross-section illustration of a switch over valve, according to an example embodiment of the present disclosure.
Figure 4B:
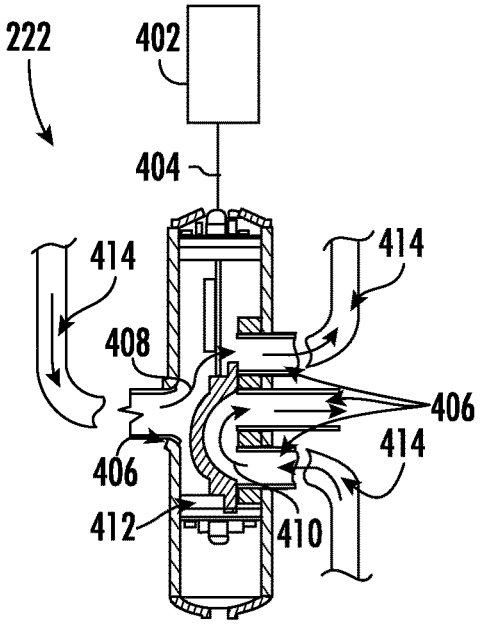
FIG. 4B is another cross-section illustration of a switch over valve, according to an example embodiment of the present disclosure.

In some embodiments, the switch over valve 122 may generally comprise a four-way reversing valve. The switch over valve 122 may also comprise an electrical solenoid, relay, and/or other device configured to selectively move a component of the switch over valve 122 between operational positions to alter the flow path of refrigerant through the switch over valve 122 and consequently the HVAC system 100. Additionally, the switch over valve 122 may also be selectively controlled by the system controller 106, the outdoor controller 126, and/or the indoor controller 124. FIGS. 4A and 4B show additional exemplary embodiments of a switch over valve that may be used in an HVAC device.

The system controller 106 may generally be configured to selectively communicate with the indoor controller 124 of the indoor unit 102, the outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the outdoor ambient temperature. Additionally, in some embodiments, the system controller 106 may comprise a temperature sensor and/or may further be configured to control heating and/or cooling of conditioned spaces or zones associated with the HVAC system 100. In other embodiments, the system controller 106 may be configured as a thermostat or hub for controlling the supply of conditioned air to zones associated with the HVAC system 100, and in some embodiments, the thermostat includes a temperature sensor.

The system controller 106 may optionally comprise an input/output (I/O) unit (e.g., a graphical user interface, a touchscreen interface, or the like) for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially related and/or unrelated to operation of the HVAC system 100. In some embodiments, the system controller 106 may not comprise a display and may derive all information from inputs that come from remote sensors and remote configuration tools.

In some embodiments, the system controller 106 may be configured for selective bidirectional communication over a communication bus 128, which may utilize any type of communication network (e.g., a controller area network (CAN) messaging, etc.). In some embodiments, portions of the communication bus 128 may comprise a three-wire connection suitable for communicating messages between the system controller 106 and one or more of the components of the HVAC system 100 configured for interfacing with the communication bus 128. Still further, the system controller 106 may be configured to selectively communicate with components of the HVAC system 100 and/or any other device 130 via a communication network 132. In some embodiments, the communication network 132 may comprise a local area network, and the other device 130 may comprise a computer. In some embodiments, the communication network 132 may comprise the Internet, and the other device 130 may comprise a smartphone and/or other Internet-enabled mobile telecommunication device.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102.

An indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116.

As described herein, system controller 106, the indoor controller 124, and the outdoor controller 126 can be collectively or individually referred to as control circuitry for effecting one or more operations of the system 100. Such operations can involve one or more steps implemented by one or more processors associated with one or more of the system controller 106, the indoor controller 124, and the outdoor controller 126. In this regard, control circuitry as described herein can include one or more processors associated with the controllers 106, 124, 126 operating to implement steps singularly or in a coordinated manner, e.g., via distribution over an electronic communication network or other networked fashion.

Figure 2:
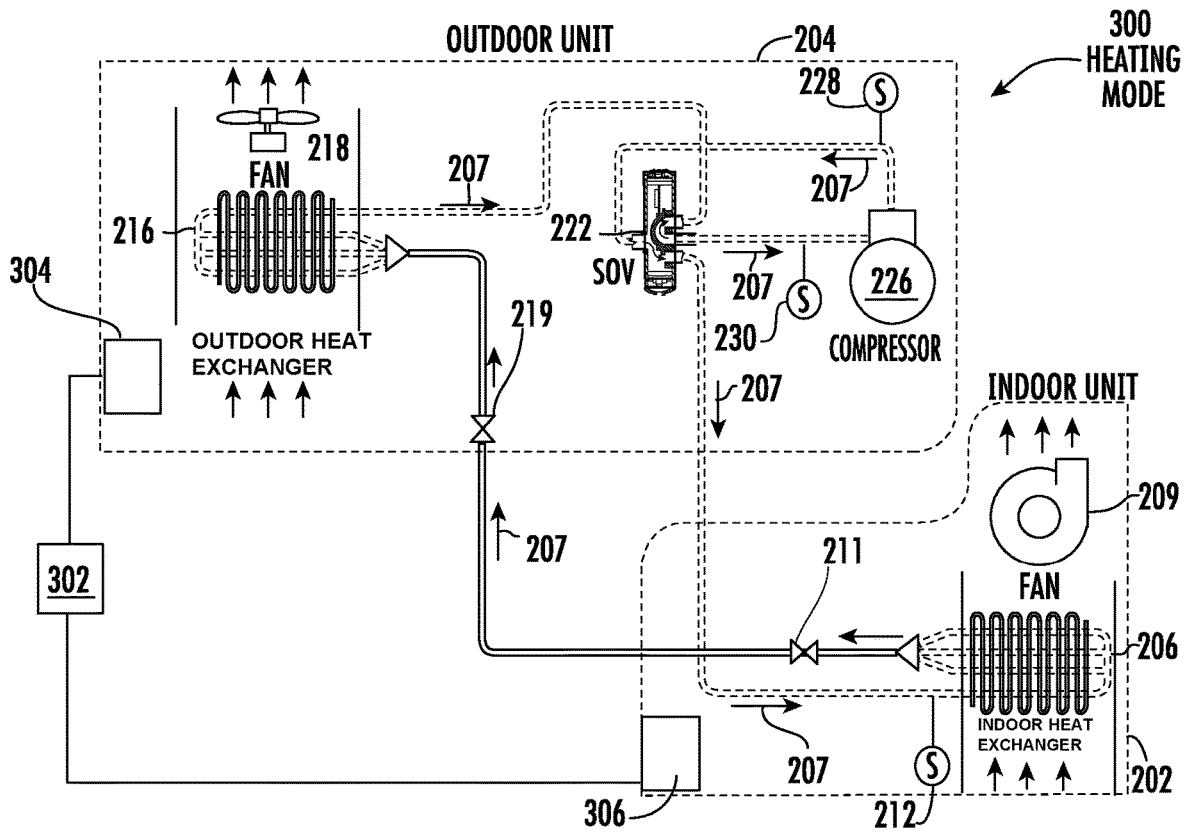
FIG. 2 is a schematic of a heating mode refrigerant cycle of an HVAC system, according to an example embodiment of the present disclosure.
Figure 3:
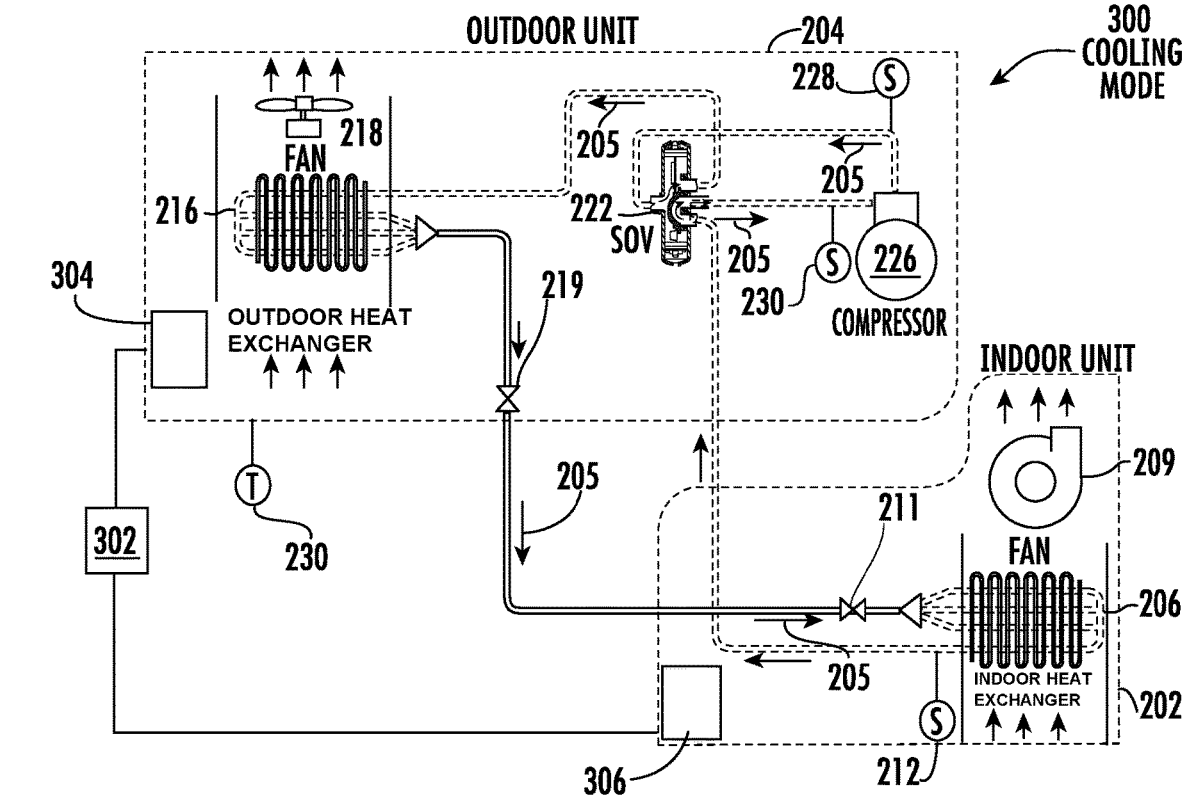
FIG. 3 is a schematic of a cooling mode refrigerant cycle of an HVAC system, according to an example embodiment of the present disclosure.

As discussed above, the HVAC system 100 may operate in at least two operating modes—a heating mode and a cooling mode. FIGS. 2 and 3 provide a more detailed illustration of these components as well as the system 100 as configured to operation in the heating mode cycle (FIG. 2) and the cooling mode cycle (FIG. 3). The configurations of the system 100 shown in FIGS. 2 and 3 are that of a split-system heat pump with an indoor unit and an outdoor unit. The below discussion is also applicable to embodiments that utilize a packaged heat pump where the components associated with the indoor unit and outdoor unit are included within a single unit. As discussed below, the refrigerant fluid may go through various phase changes in these cycles. For example, in some embodiments the refrigerant fluid changes between a liquid, a mixed fluid comprising a liquid and a gas, and a gas. In the embodiments depicted in FIGS. 2 and 3, the refrigerant fluid cycle depicted by solid lines indicates that in that embodiment, at that point, the refrigerant fluid is either a liquid or a mixed fluid. The refrigerant fluid cycle depicted by dashed lines indicates that in that embodiment, at that point, in the refrigerant cycle the refrigerant fluid is either a gas or a mixed fluid.

Turning to FIG. 2, an example schematic of a heating mode cycle of the system 100 is shown, in which the heat pump 300 is configured for the heating mode. In the depicted embodiment, the direction refrigerant fluid travels is indicated by arrows 207. Starting at compressor 226 in FIG. 2, the compressor 226 may compress the refrigerant fluid and pump to a relatively high temperature and high pressure compressed refrigerant fluid through a switch over valve 222 and to an indoor heat exchanger 206. In some embodiments, the refrigerant fluid is a gas when discharged from compressor 226 in the heating mode cycle. At the heat exchanger 206, the refrigerant fluid may transfer heat to an airflow that is passed through and/or into contact with the indoor heat exchanger 206 by an indoor fan 209. During this process, the refrigerant fluid may undergo a phase change and/or temperature change. In one embodiment, the refrigerant fluid is in a liquid state after passing through the indoor heat exchanger 206 in the heating mode cycle. After exiting the indoor heat exchanger 206, the refrigerant fluid may flow through an indoor metering device 211, such that refrigerant fluid is not substantially restricted by the indoor metering device 211. Some embodiments may include an indoor metering device bi-pass (not shown) that allows the refrigerant fluid to bi-pass the indoor metering device 211. The refrigerant fluid generally exits the indoor metering device 211 and flows to an outdoor metering device 219, which may meter the flow of the refrigerant fluid through the outdoor metering device 219, such that the refrigerant fluid downstream of the outdoor metering device 219 is at a lower pressure than the refrigerant upstream of the outdoor metering device 219. During this process, the refrigerant fluid may undergo a phase change and/or temperature change. In one embodiment, the outdoor metering device 219 changes the state of the refrigerant fluid in the heating circuit to a mixed state that comprises a liquid and gas mixture. In some embodiments, the mixed fluid is predominately a liquid, and in others, the mixed fluid is predominately a gas. From the outdoor metering device 219, the refrigerant may enter an outdoor heat exchanger 216. As the refrigerant fluid is passed through the outdoor heat exchanger 216, heat may be transferred to the refrigerant fluid from an airflow that is passed through and/or into contact with the outdoor heat exchanger 216 by an outdoor fan 218. During this process, the refrigerant fluid may undergo a phase change and/or temperature change. In one embodiment, the refrigerant fluid is in a gas state after passing through the outdoor heat exchanger 216 in the heating mode cycle. The refrigerant fluid leaving the outdoor heat exchanger 216 may flow to the switch over valve 222, where the switch over valve 222 may be selectively configured to divert the refrigerant back to the compressor 226, where the cycle may begin again.

Turning to FIG. 3, an example schematic of a cooling mode cycle of the system 100 is shown, in which the heat pump 300 is configured for the cooling mode. In the depicted embodiment, the direction the refrigerant fluid travels in this circuit is indicated by arrows 205. Starting at the compressor 226 in FIG. 3, the compressor 226 may compress the refrigerant fluid and pump a relatively high temperature and high pressure compressed refrigerant fluid through the switch over valve 222 and to the outdoor heat exchanger 216. In some embodiments, the refrigerant fluid is a gas when discharged from compressor 226 in the cooling mode cycle. At the heat exchanger 216 the refrigerant fluid may transfer heat to an airflow that is passed through and/or into contact with the outdoor heat exchanger 216 by the outdoor fan 218. During this process, the refrigerant fluid may undergo a phase change and/or temperature change. In one embodiment, the refrigerant fluid is in a liquid state after passing through the outdoor heat exchanger 216. After exiting the outdoor heat exchanger 216, the refrigerant fluid may flow through the outdoor metering device 219, such that refrigerant fluid is not substantially restricted by the outdoor metering device 219. Some embodiments may include an outdoor metering device bi-pass (not shown) that allows the refrigerant fluid to bi-pass the outdoor metering device 219. The refrigerant fluid generally exits the outdoor metering device 219 and flows to the indoor metering device 211, which may meter the flow of the refrigerant fluid through the indoor metering device 211, such that the refrigerant downstream of the indoor metering device 211 is at a lower pressure than the refrigerant upstream of the indoor metering device 211. During this process, the refrigerant fluid may undergo a phase change and/or temperature change. In one embodiment, the indoor metering device 211 changes the state of the refrigerant fluid in the cooling cycle to a mixed state that comprises a liquid and gas mixture. In some embodiments, the mixed fluid is predominately a gas, and in others, the mixed fluid is predominately a liquid. From the indoor metering device 211, the refrigerant may enter the indoor heat exchanger 206. As the refrigerant fluid is passed through the indoor heat exchanger 206, heat may be transferred to the refrigerant fluid from an airflow that is passed through and/or into contact with the indoor heat exchanger 206 by the indoor fan 209. During this process, the refrigerant fluid may undergo a phase change and/or temperature change. In one embodiment, the refrigerant fluid is in a gas state after passing through the indoor heat exchanger 206 in the cooling mode. The refrigerant fluid leaving the indoor heat exchanger 211 may flow to the switch over valve 222, where the switch over valve 222 may be selectively configured to divert the refrigerant back to the compressor 226, where the refrigerant cycle may begin again.

FIGS. 2 and 3 also show additional components that may be included in embodiments of the present disclosure. For example, the depicted embodiment illustrates a system controller 302, which in some embodiments is the same or similar to the system controller 106 described above. The depicted embodiment further includes an indoor controller 304 and an outdoor controller 306 coupled to the system controller 302, which in some embodiments are the same or a similar to indoor controller 124 and outdoor controller 126 discussed above.

The embodiments depicted in FIGS. 2 and 3 also include various sensors positioned along selected portions of the refrigerant circuit. In the illustrated embodiment, such sensors can include a sensor 228 (broadly, "first sensor" or "compressor discharge sensor") positioned along the refrigerant circuit proximate an outlet or discharge side of the compressor 226, a sensor 230 (broadly, "second sensor" or "compressor suction sensor") positioned along the refrigerant circuit proximate an inlet or suction side of the compressor 226, and a sensor 212 (broadly, "third sensor" or "heat exchanger sensor") positioned proximate the indoor heat exchanger 211. In this regard, the sensors 212, 228, 230 are in fluid communication with or otherwise configured and positioned to receive one or more parameters relating to the refrigerant at these locations. These sensors can be located at various different points in the refrigeration circuit so long as they essentially provide an indication of a sensed parameter of the refrigerant at the respective location, e.g., the compressor discharge, the compressor suction, and the indoor heat exchanger. For example, the compressor discharge sensor may be located in the compressor dome. Other sensor locations are also contemplated.

In the illustrated embodiment, various different sensors may be used. For example, the parameter sensed by these sensors may be the temperatures of the refrigerant such that the sensors 212, 228, 230 are temperature sensors. In other embodiments, these sensors may be pressure sensors and the parameter monitored may be pressure. In other embodiments, these parameters can be one or more additional or alternative properties of the refrigerant. It will be understood that one or more of the sensors 212, 228, 230 can be configured to receive multiple parameters relating to the refrigerant at a given location. While the illustrated embodiment has shown three temperature sensors at the disclosed locations along the refrigerant circuit, the present disclosure contemplates multiple different locations and configurations for such sensors.

FIGS. 4A and 4B show a cross-section of an example switch over valve 222 that may be used with this disclosure. In some embodiments, the switch over valve 222 may adjust the refrigerant fluid between a heating mode cycle, potentially the heating mode cycle depicted in FIG. 2, and a cooling mode cycle, potentially the cooling mode cycle depicted in FIG. 3. In the embodiment depicted in FIGS. 4A and 4B, the switch over valve 222 is a four-way reversing valve. In the depicted embodiment, the switch over valve 222 includes an actuator 402, actuator rod 404, valve openings 406, internal channels 408 and 410, and an internal channel chamber 412. In the depicted embodiments, the openings 406 are coupled to the refrigerant cycle via conduits 414, and allow a fluid, e.g., the refrigeration fluid, to flow between the openings 406 through the internal channels 408 and 410. In the depicted embodiments, FIG. 4A corresponds to the heating mode configuration and allows the fluid to follow through the switch over valve 222 in the heating mode cycle as depicted in FIG. 2. FIG. 4B corresponds to the cooling mode configuration and allows the fluid to follow through the switch over valve 222 in the cooling mode cycle depicted in FIG. 3.

In the depicted embodiments, the switch over valve 222 is controlled by the actuator 402 that is connected to the actuator rod 404. The actuator 402 is configured to move the components within the switch over valve 222 via the actuator rod 404. In some embodiments, the actuator 404 moves the internal channel chamber 412, which moves the internal channels 408 and 410 and results in a change in the fluid flow between the opening 406. For example, the actuator 402 may move the internal chamber 412 from the heating mode position depicted in FIG. 4A to the cooling mode position depicted in FIG. 4B via the actuator rod 404. In the depicted embodiment, this movement also moves the internal chambers 408 and 410, which results in a change in how the various openings 406 are fluidly connected. In the depicted embodiment, this may result in the refrigerant cycle switching between the heating mode cycle (FIG. 2) and the cooling mode cycle (FIG. 3). The disclosed system and method may use any manner of switch over valves, or combination of valves, provided they provide the required functionality.

For example, in some implementations, the internal channel chamber 412 can be actuated or moved to one of the heating mode position or the cooling mode position by the pressure generated within the refrigeration circuit. In these examples, a solenoid may be used to assist in the arranging the switch over valve 222 in either the heating mode position or the cooling mode position. The solenoid may restrict the movement of the components within the internal chamber, but in these embodiments, the pressure within the refrigeration circuit provides the force to move the components within the internal chamber, actually switching the switch over valve between the heating mode position and the cooling mode position. For example, one or more such solenoids can be activated to resist movement of the internal chamber 412 to the cooling mode position when the refrigerant cycle is in the heating mode. In this example, when the pressurized refrigerant fluid circulates through the switch over valve, if the valve position is in the cooling mode position the pressurized fluid will cause the valve position to change to the heating mode position. The converse may also be true, e.g., the solenoid restricts movement to the heating mode position, which due to the pressure arranges the switch over valve in the cooling mode position. Additional other arrangements and configurations may be used to control the switch over valve according to the disclosure herein.

In some situations, the switch over valve 222 can become incorrectly positioned and/or stuck at one of the heating mode position or the cooling mode position. In order to obviate the need for time-consuming and costly diagnostic and service appointments by technicians, the heat pump 300 of the system 100 described herein can be configured for determining whether a fault has occurred in the switch over valve 222 by monitoring the temperature associated with the refrigerant fluid at selected points along the refrigerant cycle. In some embodiments, the heat pump 300 of the system 100 can be configured to publish and/or transmit an alert that such a fault has occurred, and/or take one or more corrective actions with regard to these faults. Example implementations of such fault detection and optional further actions are described further below.

Figure 5:
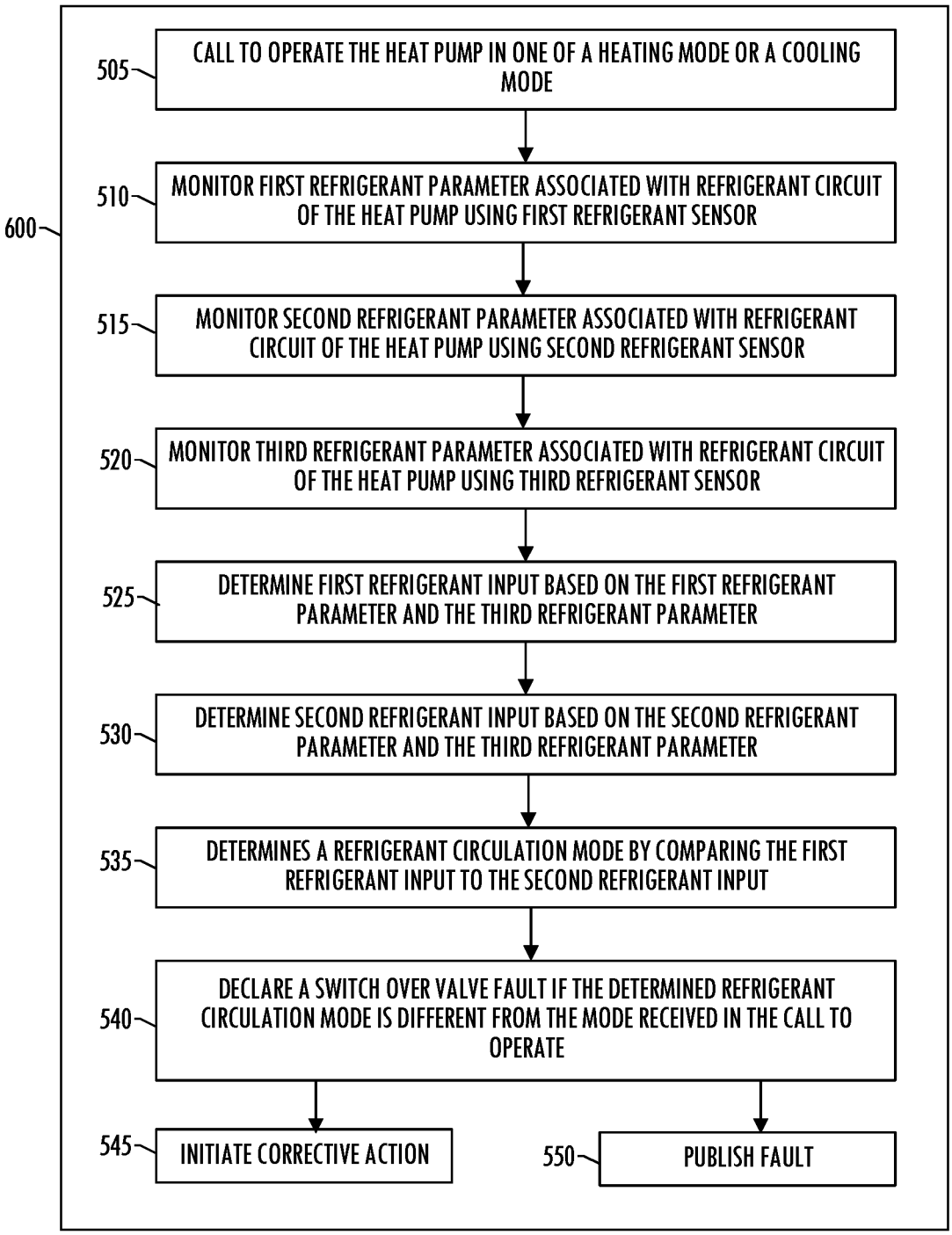
FIG. 5 is a block diagram of a fault detection system, according to an example embodiment of the present disclosure.

FIG. 5 shows a block diagram of how the disclosed system may operate to detect a fault in the heat pump, which in some embodiments includes some or all of the features discussed above. As described further herein, the fault in the heat pump can involve a fault relating to the switch over valve. Each of these steps will be discussed in more detail below, however, an overview is first provided.

At step 505 of the depicted embodiment, the control circuitry 600 sends or receives an instruction to operate the heat pump in one of a heating mode or a cooling mode, potentially via a call for either heating or cooling. Such an instruction to operate the heat pump can include one or more calls or signals generated by the system controller 106 and transmitted to one or both of the indoor controller 124 and the outdoor controller 126. At step 510, the control circuitry 600 monitors a first refrigerant parameter associated with the refrigerant circuit of the heat pump using a first refrigerant sensor located a proximate end of a discharge end of a compressor of the heat pump. At step 515, the control circuitry 600 also monitors a second refrigerant parameter associated with the refrigerant circuit of the heat pump using a second refrigerant sensor located proximate a suction end of the compressor of the heat pump. At step 520, the control circuitry 600 also monitors a third refrigerant parameter using a third refrigerant sensor located proximate a heat exchanger of the heat pump, the heat exchanger positioned in fluid communication with an indoor environment for selectively conditioning the indoor environment. At step 525, the control circuitry 600 determines a first refrigerant input based on the first refrigerant parameter and the third refrigerant parameter. At step 530, the control circuitry 600 determines a second refrigerant input based on the second refrigerant parameter and the third refrigerant parameter. At step 535, the control circuitry 600 determines a refrigerant circulation mode by comparing the first refrigerant input to the second refrigerant input, the comparison providing an indication regarding whether the refrigerant is circulating in the heating mode or the cooling mode. At step 540, the control circuitry 600 declares a switch over valve fault if the determined refrigerant circulation mode is different from the mode sent or received in the call to operate. In these embodiments, the control circuitry 600 may declare a fault after a certain period of time has passed. Some embodiments include a step 545 where the control circuitry 600 initiates corrective action in an attempt to fix the fault. Some embodiments include a step 550 where the control circuitry 600 publishes the fault. At this step of some embodiments, the control circuitry 600 sends an alert to publish the fault.

To walk through these steps in more detail, at step 505, the control circuitry 600 may send or receive an instruction to operate the heat pump in a given operating mode, e.g., a heating call or a cooling call. In some embodiments, the control circuitry 600 also controls the operating mode of the heat pump. In these embodiments, the control circuitry 600 may make the determination to operate the heat pump in a given operating mode and receive the instruction to operate in a given operating mode in the same or related process(es). In some embodiments, a user may select the operating mode for the heat pump, for example, at a thermostat or hub that forms a part of the control circuitry 600 such that the control circuitry 600 may receive this instruction via the user input. In some embodiments, the control circuitry 600 may include sensors that receive and determine the operating mode of the heat pump, which may also include providing an instruction to the control circuitry regarding the intended operating mode of the heat pump. For example, in some embodiments, the heat pump may include a thermostat in a conditioned space. In these embodiments, the user may have set a desired temperature set point for the conditioned space. The thermostat may monitor the temperature of the conditioned space via a temperature sensor. The thermostat may direct the heat pump to operate in a heating mode when the temperature measured by the thermostat is under the desired temperature set point for the conditioned space, and it may direct the heat pump to operate in a cooling mode when the temperature measured by the thermostat is above the desired temperature set point. In these embodiments, the control circuitry is configured to send a call for heating (or cooling) via the thermostat and also to receive such a call to direct the heat pump to operate in a given operating mode.

At steps 510, 515, and 520, the control circuitry 600 may receive information associated with parameters of the refrigerant fluid in the refrigerant circuit. In some embodiments, the control circuitry 600 receives such parameters in the form of temperature information associated with the refrigerant fluid circulating within the refrigerant circuit. The control circuitry 600 may receive this temperature information in a variety of different ways including one or more temperature sensors, though auxiliary systems (e.g., remote database servers, internet), user input, calculation based methods, modeling simulations, or other techniques can also be used. In some embodiments, the control circuitry 600 converts the temperature information it receives into temperature inputs that may be used by the control circuitry 600 to perform additional functions. In some embodiments, the temperature inputs comprise the temperature information received either via a signal or otherwise.

In some embodiments where temperature sensors are used, a temperature sensor may be any device configured to measure temperature and provide the control circuitry 600 with a signal indicative of the temperature measured. The temperature signal may be transmitted to the control circuitry 600 to provide information regarding the temperature measured by the temperature sensor. The temperature signal may be any communication signal used to transmit this information. In some embodiments, the temperature signal is an electrical signal comprising a voltage and/or amperage indicative of the temperature measured by the temperature sensor. The control circuitry 600 may utilize other types of temperature signals (e.g., optical signals, wireless communication protocols, etc.). In some embodiments, the temperature signal may be transmitted through multiple devices and multiple forms (e.g., a wireless temperature sensor transmitting a temperature signal to a remote server, etc.). In some embodiments, the control circuitry 600 determines a temperature sensor input, where the temperature sensor input is based in whole or in part on the temperature signal. The temperature sensor input is also indicative of the temperature measured by the temperature sensor, and the control circuitry 600 uses the temperature signal to determine the temperature sensor input.

In some embodiments, the temperature information associated with the refrigerant fluid is provided to and received by the control circuitry 600 via a temperature sensor. In some embodiments, a temperature sensor is coupled to the refrigerant cycle to monitor the temperature of refrigerant fluid. In some embodiments, such as the embodiments depicted in FIGS. 2 and 3, the heat pump 300 includes three temperature sensors coupled to the refrigerant cycle. One temperature sensor 212 is located along the refrigerant circuit proximate the indoor heat exchanger 206 to provide a third refrigerant parameter, one temperature sensor 228 is located along the refrigerant circuit at or proximate a discharge side of the compressor 226 of the heat pump 300 to provide a first refrigerant parameter, and one temperature sensor 230 is located along the refrigerant circuit at or proximate a suction side of the compressor 226 of the heat pump 300 to provide a second refrigerant parameter.

In some embodiments, the temperature sensor 212 measures the temperature of the refrigerant fluid entering or exiting the coils of the indoor heat exchanger 206. For example, in a heating mode, the temperature sensor 212 may measure the temperature of the refrigerant fluid entering the coils of the indoor heat exchanger 206, and in the cooling mode, the temperature sensor 212 may measure the temperature of the refrigerant fluid exiting the coils of the indoor heat exchanger 206. In some embodiments, this temperature sensor 212 measures this temperature in between the indoor metering device 211 and the indoor heat exchanger 206. In this regard, the temperature sensor 212 can be positioned along the refrigerant circuit so as to measure a temperature of the refrigerant fluid when it is in an at least partially gaseous form during both the heating mode and the cooling mode of the heat pump.

In some embodiments, the control circuitry 600 uses information from temperature sensor 228 to create a refrigerant input. In some embodiments, the control circuitry 600 receives temperature information from both of the sensors 212 and 228 and uses the temperature information provided by one or both of these sensors to create a refrigerant input.

The control circuitry may receive and process information associated with other parameters of the refrigerant fluid, e.g., pressure, in the same or similar manner as described herein with regard to temperature.

At step 525, the control circuitry 600 determines a first refrigerant input based on the first refrigerant parameter and the second refrigerant parameter. In the illustrated embodiment, the control circuitry 600 can determine the first refrigerant input based on the difference between one or more signals from the sensor 228 and one or more corresponding signals from the sensor 212. In this regard, in some embodiments, the first refrigerant input ($R_1$) can be determined as the difference in temperature of the refrigerant fluid at or proximate the discharge side ($T_D$) of the compressor 226 and the refrigerant fluid at or proximate the indoor heat exchanger 206 ($T_{HE}$) such that $R_1=T_D-T_{HE}$. In some embodiments, the control circuitry 600 uses the absolute value of the difference in temperature of the refrigerant fluid at or proximate the discharge side of the compressor 226 and the temperature of the refrigerant fluid at or proximate the indoor heat exchanger 206 to determine the first refrigerant input. Other methods for determining this difference are contemplated within the scope of this disclosure.

With continued reference to FIG. 5, at step 530, the control circuitry 600 determines a second refrigerant input based on the second refrigerant parameter and the third refrigerant parameter. In the illustrated embodiment, the control circuitry 600 can determine the second refrigerant input based on the difference between one or more signals from the sensor 230 and one or more corresponding signals from the sensor 212. In this regard, the second refrigerant input ($R_2$) can be determined as the difference in temperature of the refrigerant fluid at or proximate the suction side of the compressor 226 (Ts) and the refrigerant fluid at or proximate the indoor heat exchanger 206 ($T_{HE}$) such that $R_2=T_{HE}-T_S$. In some embodiments, the control circuitry 600 uses the absolute value of the difference in temperature of the refrigerant fluid at or proximate the suction side of the compressor 226 and the temperature of the refrigerant fluid at or proximate the indoor heat exchanger 206 to determine the second refrigerant input. Other methods for determining this difference are contemplated within the scope of this disclosure.

At step 535, the control circuitry 600 compares the first refrigerant input determined from step 525 and the second refrigerant input determined from step 530 to make a measured determination of whether the switch over valve is in the heating mode position or the cooling mode position based on the difference in temperatures provided by the sensors 212, 228, 230 outlined above. In this regard, the control circuitry 600 uses the sensors 212, 228, 230 to measure actual properties of the refrigerant fluid in the refrigerant circuit so as to confirm the operating mode of the heat pump. In some embodiments, the first refrigerant input and the second refrigerant input can be compared so as to determine whether the first refrigerant input is greater than the second refrigerant input or whether the second refrigerant input is greater than the first refrigerant input. In some embodiments, if $R_1>R_2$ then it provides an indication that the heat pump is in cooling mode, and if $R_1<R_2$ then it provides an indication that the heat pump is in heating mode.

In some embodiments, the first refrigerant input and/or the second refrigerant input may be indicative of the heating or cooling mode without comparing these values to each other. For example, the first refrigerant input may be compared against a threshold value to provide the indication of whether the heat pump is in a heating mode or cooling mode. This first threshold value may be indicative of a standard or expected second refrigerant input for the heating or cooling mode. Or it may be a value that the first refrigerant input would either above or below if the system is in a heating or cooling mode.

In another example, a threshold value against which the first refrigerant input is compared can be a value with a small absolute value, indicating that a selected property of the refrigerant at or proximate the discharge side of the compressor is similar to or within a preselected range relative to such property of the refrigerant fluid at or proximate the indoor heat exchanger 206. Accordingly, if the absolute value of the first refrigerant input is less than the preselected value or within the preselected range, the first refrigerant input may be indicative of the heating mode. Alternatively, if the absolute value of the first refrigerant input is greater than the preselected value or outside of the preselected range, the first refrigerant input may be indicative of the cooling mode. In this regard, the first refrigerant input may be characterized as a "yes" or "true" or "no" or "false" signal.

In these examples, it may not be necessary to determine the second refrigerant input and/or compare the first refrigerant input to the second refrigerant input. Similarly, the second refrigerant input may be compared again a threshold value to provide the indication of whether the heat pump is in a heating mode or cooling mode in the same or similar manner.

Some embodiments include a filtering step in which the control circuitry 600 can determine the average values for the first refrigerant input and the second refrigerant input over a predetermined time period before making such comparison. In one embodiment, such time period can be about 5 minutes. Such time period can be greater or smaller than 5 minutes without departing from the disclosure, for example, 1 minute, 2 minutes, 3 minutes, 4 minutes, 6 minutes, 7 minutes, 8 minutes, 9 minutes, 10 minutes, and non-integer values therebetween.

At step 540, the control circuit 600 may determine and/or declare whether a switch over valve fault exists. In some embodiments, the control circuitry 600 determines a fault exists if the determination of whether the switch over valve 222 is in the heating mode position or in the cooling mode position determined in step 535 is inconsistent with the call for the heat pump operating mode sent or received at step 505. The fault may be declared in a variety of ways. In some embodiments, the control circuitry 600 declares this fault by generating a signal representative that a fault exists in the system. In some embodiments, the control circuitry 600 takes a given action, and this action is based on (and/or indicative of) a fault being declared.

In some embodiments, the control circuitry 600 may only declare a fault when the temperature comparison indicates a fault has occurred and other factors corroborate this indication. For example, in some embodiments, the control circuitry 600 includes a timer and only determines a fault has occurred after the determination of an inconsistency between switch over valve position as determined in step 535 and the call sent or received at step 505 for a set period of time. In some embodiments, this fault is declared when an inconsistency between switch over valve position as determined in step 535 and the call sent or received at step 505 is determined a certain number of times within a given period of time, or for a certain percentage of a given time period.

In some embodiments, the fault declared at step 540 may indicate that the switch over valve 222 is not circulating the refrigerant fluid in the appropriate refrigerant cycle. In some embodiments, the fault declared indicates that the switch over valve is circulating the refrigerant fluid in a heating mode refrigerant cycle when the heat pump is intended to be operated in a cooling mode, or that the switch over valve is circulating the refrigerant fluid in a cooling mode refrigerant cycle when the heat pump is intended to be operated in a heating mode. In some embodiments, the fault indicates that the switch over valve is in a heating mode position, for example the heating mode position shown in FIG. 4A, when a cooling call has been sent or received by the control circuitry 600. In some embodiments, the fault indicates that the switch over valve is in a cooling mode position, for example the cooling mode position shown in FIG. 4B, when a heating call has been sent or received by the control circuitry 600. The disclosure contemplates other faults that may be declared by the control circuitry at this step.

Some embodiments include a step 545 where the control circuitry 600 takes corrective action once a fault has been declared. In some embodiments, this corrective action is directed to the switch over valve and seeks to ensure that the refrigerant fluid is being circulated in the appropriate cycle based on the intended operation of the heat pump. In some embodiments, the switch over valve is an electronically controlled switch over valve, and the corrective action includes de-energizing the switch over valve and then re-energizing the switch over valve. In some embodiments, the process of de-energizing the switch over valve includes terminating the electrical current to the switch over valve, and the process of re-energizing the switch over valve includes initiating an electrical current to the switch over valve. In some embodiments, the control circuitry 600 may repeat a pattern of de-energizing and re-energizing the switch over valve several times (e.g., up to 10 times or more).

Other corrective actions are contemplated within the scope of this disclosure. For example, in some embodiments, the control circuitry 600 may initiate a lock down of the system 100 or one or more components thereof after a predetermined number of switch over valve faults have occurred. Such lock down can include an at least partial deactivation of one or more components of the system 100 and/or the initiation of one or more control interlocks on one or more components of the system 100, for example, the heat pump 300. Such control interlocks can require a user input or override in order to be bypassed. In some embodiments, such action may be limited to authorized personnel or technicians. In one embodiment, a lock down can include a total deactivation of the system 100 or one or more components thereof.

Some embodiments include the step 550 where the control circuitry 600 publishes the fault once it has been declared. In some embodiments, this fault is published on a display, which may be included on the indoor controller, outdoor controller, system controller, and/or a thermostat display. In some embodiments, the control circuitry 600 transmits an indication or an alert that a fault has occurred to a remote device, potentially a remote server or other device, that provides an indication a fault has occurred in the system. In these embodiments, the fault may be visually published on a separate device such as a computer, cell phone, tablet, or other device.

Figure 6:
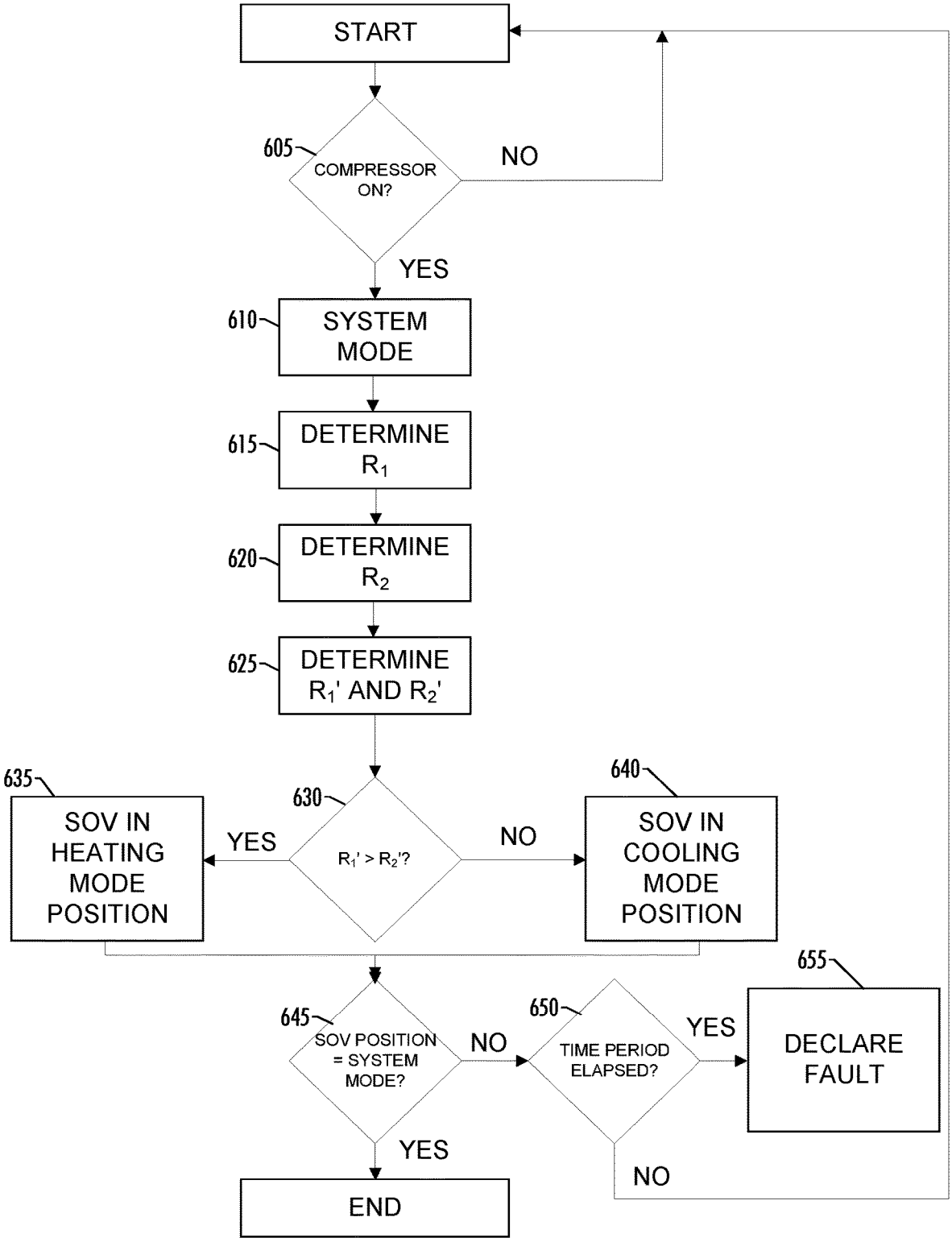
FIG. 6 is another block diagram of a fault detection system, according to an example embodiment of the present disclosure.

FIG. 6 shows an example embodiment of the present disclosure determining whether a switch over valve fault has occurred. In this embodiment, at step 605, the control circuitry 600 determines whether the compressor of the HVAC system is on, i.e., so as to determine whether the HVAC system is actively running to heat or cool a conditioned space. In some embodiments, the control circuitry may 600 may determine one or more other preconditions of the HVAC system is satisfied in conjunction with step 605. In one example, such precondition may include a determination or receipt of a signal confirmation that one or more of the sensors, 212, 228, 230 are operational and/or operating within one or more predetermined parameters.

If the control circuitry 600 determines that the compressor of the HVAC system is on, a system mode of the HVAC system is determined at step 610. As described above, in some embodiments, the system mode of the HVAC system is related to a call sent or received by the control circuitry 600 to operate the heat pump in a given mode, e.g., a heating call or a cooling call. In some embodiments, the control circuitry 600 controls the operating mode of the heat pump. In some embodiments, a user may select the operating mode for the heat pump, and the control circuitry 600 may receive this instruction via the user input. In some embodiments, the control circuitry 600 may include sensors that receive and determine the operating mode of the heat pump, which may also include providing an instruction to the control circuitry regarding the intended operating mode of the heat pump.

Proceeding to step 615, the control circuitry determines a first refrigerant input ($R_1$) based on the difference between one or more signals from the sensor 228 and one or more corresponding signals from the sensor 212. In this regard, the first refrigerant parameter can be determined as the difference in temperature, pressure, or other parameter of the refrigerant fluid at or proximate the discharge side of the compressor 226 and the refrigerant fluid at or proximate the indoor heat exchanger 206.

At step 620, the control circuitry determines the second refrigerant input ($R_2$) based on the difference between one or more signals from the sensor 212 and one or more corresponding signals from the sensor 230. In this regard, the second refrigerant parameter can be determined as the difference in temperature, pressure, or other parameter of the refrigerant fluid at or proximate the indoor heat exchanger 206 and the temperature of the refrigerant at or proximate the suction side of the compressor 226.

With continued reference to FIG. 6, at step 625, the values determined for the first refrigerant input $R_1$ and the second refrigerant input $R_2$ can be filtered by the control circuitry 600. In some embodiments, the filtering of the first refrigerant input $R_1$ and the second refrigerant input $R_2$ can be taken as an average over a predetermined time period to produce a filtered first refrigerant input $R_1'$ and a filtered second refrigerant input $R_2'$. In one embodiment, such time period can be about 5 minutes. In some embodiments, such filtering step may be omitted and the switch over fault detection process can proceed without averaging the first refrigerant input and the second refrigerant input over any predetermined time period.

Proceeding to step 630, the control circuitry 600 determines whether the filtered first refrigerant input $R_1'$ is greater than the filtered second refrigerant input $R_2'$. If the filtered refrigerant input $R_1'$ is determined by the control circuitry to be greater than the refrigerant input $R_2'$, then the control circuitry 600 determines the switch over valve 222 to be in a heating mode position at step 635. However, if the filtered refrigerant input $R_1'$ is determined by the control circuitry 600 to not be greater than the filtered refrigerant input $R_1'$, e.g., such that the filtered refrigerant input $R_2'$ is greater than the filtered refrigerant input $R_1'$, the control circuitry 600 determines the switch over valve 222 to be in a cooling mode position at step 640.

With continued reference to FIG. 6, the control circuitry 600 may determine and/or declare whether a fault exists if the determination of whether the switch over valve 222 is in the heating mode position or in the cooling mode position determined in steps 635, 640 is consistent or inconsistent with the system mode received at a step 645. If the determination of the switch over valve position from steps 635, 640 is consistent with the system mode from step 610, the heat pump continues operation without a fault being declared.

However, if the determination of the switch over valve position from steps 635, 640 is inconsistent with the system mode from step 610, the control circuitry 600 declares a switch over valve fault at step 655. In some embodiments, the fault indicates that the switch over valve is not circulating the refrigerant fluid in the appropriate cycle based on the operating call sent or received by the control circuitry. In the embodiment depicted in FIG. 6, the fault may indicate that the switch over valve is circulating the refrigerant fluid in a cooling mode cycle when the system has sent or received a heating call. In some embodiments, the control circuitry initiates corrective action by de-energizing and then re-energizing the switch over valve once the fault has been declared. In some embodiments, the control circuitry publishes the fault once the fault has been declared.

In some embodiments, and as described herein, the control circuitry 600 can be configured to only declare a switch over valve fault unless and until and other factors corroborate this indication. For example, at an optional step 650, the control circuitry 600 can confirm whether a predetermined time period has elapsed before declaring a switch over valve fault. Such predetermined time period can be measured, for example, from a time associated with a call for an operating mode of the heat pump as indicated by the system mode collected in step 610. Some embodiments also continuously monitor the refrigerant inputs via sensors 212, 228, 230 to determine if a fault is occurring and/or the system is operating appropriately independently of any predetermined time period.

Figure 7:
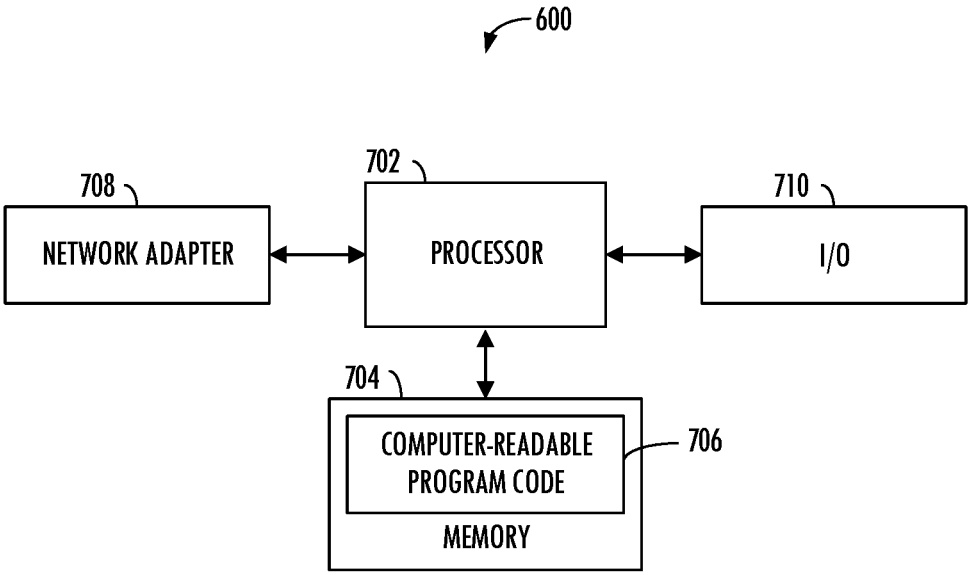
FIG. 7 is an illustration of control circuitry, according to an example embodiment of the present disclosure.

FIG. 7 illustrates the control circuitry 600 according to some example embodiments of the present disclosure. The control circuitry may include one or more of each of a number of components such as, for example, a processor 702 connected to a memory 704. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 702 may be a number of processors, a multi-core processor or some other type of processor, depending on the particular embodiment.

The processor 702 may be configured to execute computer programs such as computer-readable program code 706, which may be stored onboard the processor or otherwise stored in the memory 704. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 704 is generally any piece of computer hardware capable of storing information such as, for example, data, computer-readable program code 706 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 702, causes the control circuitry 600 to perform various operations as described herein, some of which may in turn cause the HVAC system to perform various operations.

In addition to the memory 704, the processor 702 may also be connected to one or more peripherals such as a network adapter 708, one or more input/output (I/O) devices 710 or the like. The network adapter is a hardware component configured to connect the control circuitry 710 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

In some embodiments, the control circuitry may be included within some or all of the following component discussed above, e.g., the system controller, the outdoor unit controller, and/or the indoor unit controller. In some embodiments, the control circuitry includes a CAN messaging network. In some embodiments, the CAN messaging network is included within the system controller, and in some embodiments, the system controller includes the control circuitry for detecting a fault when the system is operating in a heating mode and detecting a fault when the system is operating in a cooling mode. In some embodiments, the temperature information and/or the temperature inputs are represented as CAN messages and processed according the disclosed system and method within the CAN messaging network.

In some embodiments, the control circuitry for determining a fault when the system is operating in a cooling mode is located in the outdoor controller. In some of these embodiments, the control circuitry for determining a fault when the system is operating in a heating mode is located in the indoor controller. The control circuitry as described herein can include one or more processors associated with the system controller, the indoor controller, and the outdoor controller operating to implement steps singly or in a coordinated manner, e.g., via distribution over an electronic communication network or other networked fashion. In some embodiments, such control circuitry can be provided in a single unit, e.g., a utility or hardware enclosure.

In some of these embodiments, the control circuitry may publish a fault once detected on a display, which may be included on a thermostat. Other configurations for the control circuitry and communication networks are contemplated within the scope of the present disclosure.

Many modifications and other embodiments of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments disclosed and that modifications and other embodiments are intended to be included within the scope of the appended claims. Moreover, although the foregoing description and the associated figures describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heat pump comprising:

a compressor, a metering device, a first heat exchanger, and a second heat exchanger, the second heat exchanger positioned in fluid communication with an indoor environment for selectively conditioning the indoor environment;

a refrigerant circuit comprising a refrigerant fluid arranged to circulate between the first heat exchanger and the second heat exchanger;

a first refrigerant sensor configured to provide a signal indicative of a first refrigerant parameter, the first refrigerant parameter being a parameter of refrigerant fluid flowing away from the compressor;

a second refrigerant sensor configured to provide a signal indicative of a second refrigerant parameter, the second refrigerant parameter being a parameter of refrigerant fluid flowing into the compressor;

a third refrigerant sensor configured to provide a signal indicative of a third refrigerant parameter, the third refrigerant parameter being a parameter of refrigerant fluid proximate the second heat exchanger;

a switch over valve coupled to the refrigerant circuit configured to adjust a path of the refrigerant fluid between the first heat exchanger and the second heat exchanger in the refrigerant circuit, wherein the switch over valve comprises a heating mode position that directs the refrigerant fluid in a heating mode cycle to heat the indoor environment, and a cooling mode position that directs the refrigerant fluid in a cooling mode cycle to cool the indoor environment; and control circuitry, wherein the control circuitry is configured to:

send or receive a call, the call indicative of whether to heat the indoor environment or cool the indoor environment;

determine a first refrigerant input indicative of a difference in parameters of the refrigerant fluid based on at least one difference between the signal from the first refrigerant sensor and the signal from the third refrigerant sensor;

determine a second refrigerant input indicative of a difference in parameters of the refrigerant fluid based on at least one difference between the signal from the second sensor and the signal from the third refrigerant sensor;

determine whether the switch over valve is in the heating mode position or the cooling mode position by comparing the first refrigerant input to the second refrigerant input; and declare a switch over valve fault if the determined switch over valve position is inconsistent with the call.

2. The heat pump of claim 1, wherein the first, second, and third refrigerant sensors are temperature sensors, and the first, second, and third refrigerant parameters are temperatures of the refrigerant.

3. The heat pump of claim 1, wherein the third refrigerant sensor is located at a position along the refrigerant circuit where the refrigerant is in a gas phase during both the heating mode cycle and the cooling mode cycle.

4. The heat pump of claim 1, wherein the control circuitry is further configured to:

measure a time period that starts when the call is received; and declare the switch over valve fault if both the determined switch over valve position is inconsistent with the call and the measured time period has exceeded a predetermined time period.

5. The heat pump of claim 1, wherein the control circuitry configured to determine the first refrigerant input further includes control circuitry to determine the first refrigerant input by filtering the signals from the first refrigerant sensor and the third refrigerant sensor, and wherein the control circuitry configured to determine the second refrigerant input further includes control circuitry to determine the second refrigerant input by filtering the signals from the second refrigerant sensor and the third refrigerant sensor.

6. The heat pump of claim 1, wherein the first refrigerant parameter signal corresponds to a refrigerant discharge value, the third refrigerant parameter signal corresponds to a second heat exchanger value, and the control circuitry configured to determine the first refrigerant input includes control circuitry configured to subtract the second heat exchanger value from the refrigerant discharge value.

7. The heat pump of claim 1, wherein the second refrigerant parameter signal corresponds to a refrigerant suction value, the third refrigerant parameter signal corresponds to a second heat exchanger value, and the control circuitry configured to determine the second refrigerant input includes control circuitry configured to subtracting the refrigerant suction value from the second heat exchanger value.

8. The heat pump of claim 1, wherein the determination whether the switch over valve is in the heating mode position or the cooling mode position includes a determination the switch over valve is in the cooling mode position if the first refrigerant input is greater than the second refrigerant input or a determination the switch over valve is in the heating mode position if the second refrigerant input is greater than the first refrigerant input.

9. The heat pump of claim 1, wherein the control circuitry is further configured to deactivate the compressor upon a declaration that a switch over valve fault has occurred.

10. The heat pump of claim 9, wherein the control circuitry is further configured to activate the compressor after a predetermined reset time period following deactivation of the compressor.

11. The heat pump of claim 1, wherein the control circuitry is further configured to:

de-energize the switch over valve upon a declaration that a switch over valve fault has occurred; and re-energize the switch over valve after de-energizing the switch over valve.

12. The heat pump of claim 1, wherein the control circuitry is further configured to lock down the heat pump after a predetermined number of switch over valve faults have occurred.

13. A method for detecting a switch over valve fault in a heat pump, the method comprising:

sending or receiving a call to operate the heat pump in one of a heating mode and a cooling mode;

monitoring a first refrigerant parameter associated with a refrigerant circuit of the heat pump using a first refrigerant sensor located proximate a discharge end of a compressor of the heat pump, the first refrigerant parameter being a parameter of refrigerant fluid flowing away from the compressor;

monitoring a second refrigerant parameter associated with the refrigerant circuit of the heat pump using a second refrigerant sensor located proximate a suction end of the compressor of the heat pump, the second refrigerant parameter being a parameter of refrigerant fluid flowing into the compressor;

monitoring a third refrigerant parameter using a third refrigerant sensor located proximate a heat exchanger of the heat pump, the third refrigerant parameter being a parameter of refrigerant fluid proximate the heat exchanger, the heat exchanger positioned in fluid communication with an indoor environment for selectively conditioning the indoor environment;

determining a first refrigerant input based on the first refrigerant parameter and the third refrigerant parameter;

determining a second refrigerant input based the second refrigerant parameter and the third refrigerant parameter;

determining a refrigerant circulation mode by comparing the first refrigerant input to the second refrigerant input, the comparison providing an indication regarding whether the refrigerant is circulating in the heating mode or the cooling mode; and declaring a switch over valve fault if the determined refrigerant circulation mode is different from the mode sent or received in the call to operate.

14. The method of claim 13, wherein the first, second, and third refrigerant sensors are temperature sensors, and the first, second, and third refrigerant parameters are temperatures of the refrigerant.

15. The method of claim 13, wherein the third refrigerant sensor is located at a position along the refrigerant circuit where the refrigerant is in a gas phase during both the heating mode and the cooling mode of the heat pump.

16. The method of claim 13, further comprising:

measuring a time period that starts when the call to operate the heat pump in the heating mode or the cooling mode is sent or received; and declaring the switch over valve fault if both the determined refrigerant circulation mode is different from the mode sent or received in the call to operate and the measured time period has exceeded a predetermined time period.

17. The method of claim 13, wherein determining the first refrigerant input further includes averaging the respective signals from the respective first refrigerant sensor and the third refrigerant sensor over a predetermined time period, and determining the second refrigerant input further includes averaging the respective signals from the respective second refrigerant sensor and the third refrigerant sensor over the predetermined time period.

18. The method of claim 13, wherein the first refrigerant parameter signal corresponds to a refrigerant discharge temperature value ($T_D$), the second refrigerant parameter signal corresponds to a refrigerant suction temperature value ($T_S$), the third refrigerant parameter signal corresponds to a refrigerant heat exchanger temperature value ($T_{HE}$), and the first refrigerant input ($R_1$) is determined using the following equation: $R_1=T_D-T_{HE}$.

19. The method of claim 18, wherein the second refrigerant input ($R_2$) is determined using the following equation: $R_2=T_{HE}-T_S$.

20. The method of claim 19, wherein determining the refrigerant circulation mode further includes determining the refrigerant circulation mode is in cooling mode if $R_1>R_2$ or determining the refrigerant circulation mode is in heating mode if $R_1<R_2$.

21. The method of claim 13, further comprising deactivating the compressor upon a determination that a switch over valve fault has occurred.

22. The method of claim 21, further comprising activating the compressor after a predetermined reset time period following deactivation of the compressor.

23. The method of claim 13, further comprising:

de-energizing the switch over valve upon a determination that a switch over valve fault has occurred; and re-energizing the switch over valve after de-energizing the switch over valve.

24. The method of claim 13, further comprising locking down the heat pump after a predetermined number of switch over valve faults have occurred.

* * * * *